US009533329B2

(12) United States Patent
Hall

(10) Patent No.: US 9,533,329 B2
(45) Date of Patent: Jan. 3, 2017

(54) VENDING CLEANING SYSTEM

(71) Applicant: Lessie Lee Hall, Memphis, TN (US)

(72) Inventor: Lessie Lee Hall, Memphis, TN (US)

( * ) Notice: Subject to any disclaimer, the term of this patent is extended or adjusted under 35 U.S.C. 154(b) by 32 days.

(21) Appl. No.: 14/595,409

(22) Filed: Jan. 13, 2015

(65) Prior Publication Data

US 2015/0375277 A1 Dec. 31, 2015

Related U.S. Application Data

(60) Provisional application No. 62/018,976, filed on Jun. 30, 2014.

(51) Int. Cl.

| | |
|---|---|
| ***B08B 9/08*** | (2006.01) |
| ***B08B 3/04*** | (2006.01) |
| ***B08B 1/00*** | (2006.01) |
| ***G07F 9/00*** | (2006.01) |
| *B08B 9/00* | (2006.01) |

(52) U.S. Cl.

CPC . *B08B 3/04* (2013.01); *B08B 1/00* (2013.01); *G07F 9/00* (2013.01); *B08B 9/00* (2013.01)

(58) Field of Classification Search

CPC ..... B08B 9/093; B08B 1/00; B08B 3/04; B08B 9/00; G07F 9/00

USPC ..... 134/169 R

See application file for complete search history.

(56) References Cited

U.S. PATENT DOCUMENTS 3,173,433 A * 3/1965 Wynne ..... A47L 15/4236 134/169 R
4,848,381 A * 7/1989 Livingston ..... A23G 7/00 134/100.1
5,056,875 A * 10/1991 Akins ..... A61B 19/081 222/183
6,056,154 A * 5/2000 Fowler ..... B67D 3/00 222/1
6,422,422 B1 * 7/2002 Forbes ..... B67D 1/0041 222/129.1
7,089,763 B2 * 8/2006 Forsberg ..... E03B 3/28 62/285
7,131,468 B2 * 11/2006 Schuman ..... B01F 13/1055 141/100
2004/0129725 A1 * 7/2004 Bertone ..... A47J 31/41 222/129.4
2006/0261156 A1 * 11/2006 Brown ..... B67D 7/02 235/381
2007/0175062 A1 * 8/2007 Toshima ..... H01L 21/67028 34/410
2008/0148959 A1 * 6/2008 Bockbrader ..... A47J 31/402 99/323.3

(Continued)

*Primary Examiner* — Michael Barr

*Assistant Examiner* — Benjamin L Osterhout

(74) *Attorney, Agent, or Firm* — The Law Office of Jerry D. Haynes

(57) ABSTRACT

A cleaning system for a vending machine including: a fluid container, where the fluid container is installed on an interior surface of a door of the vending machine; a tubing system extending from the fluid container along the sides of the door; and a pump switch configured in line with the tubing system, where the pump enables the flow of the fluid through the tubing system. The tubing system may include a container tubing extending from the fluid container to the pump switch. The tubing system may also include a side tubing extending from the pump switch and said side tubing connects to a top tubing, where the fluid dispenses from the top tubing.

4 Claims, 1 Drawing Sheet

(56) References Cited

U.S. PATENT DOCUMENTS

| | | | | |
|---|---|---|---|---|
| 2009/0139605 | A1* | 6/2009 | Bellens | B01F 13/1055 141/313 |
| 2010/0275956 | A1* | 11/2010 | Curtin | B08B 3/006 134/104.2 |
| 2011/0042202 | A1* | 2/2011 | Pettee | A61L 2/22 204/228.2 |
| 2011/0163116 | A1* | 7/2011 | Dixon | B67D 1/0802 222/1 |

* cited by examiner

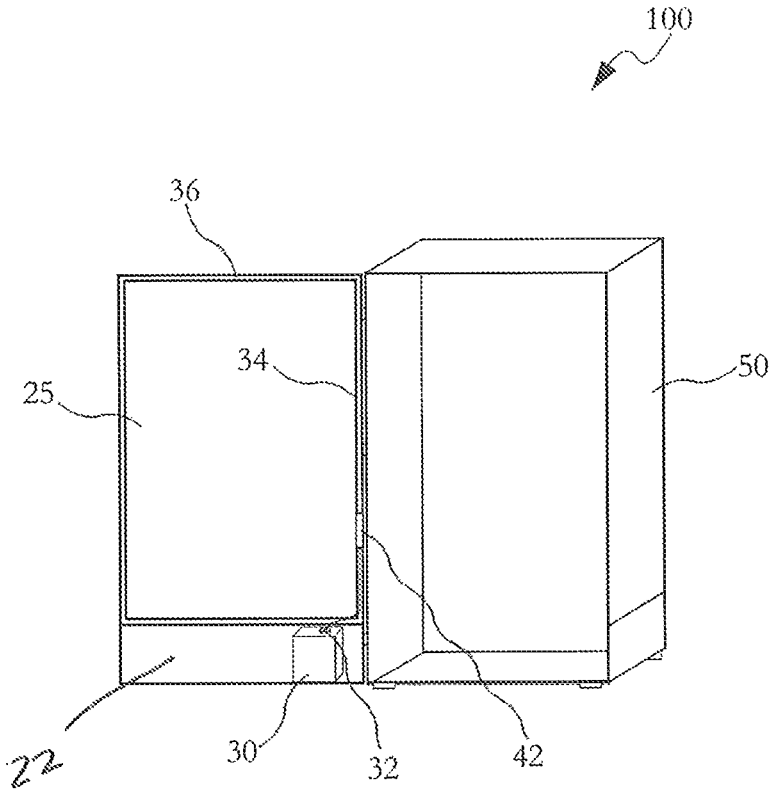
100
36
34
25
50
22
30
32
42

VENDING CLEANING SYSTEM

CROSS REFERENCE TO OTHER APPLICATIONS

This application claims priority to U.S. Provisional Application Ser. No. 62/018,976 filed on Jun. 30, 2014.

BACKGROUND OF THE INVENTION

Field of Invention

The present invention relates to a cleaning system that is implemented within a standard vending machine.

Description of Related Art

Vending machines are stand-alone machines that dispense various items such as snacks, beverages, cigarettes or other small consumer products. Vending machines may be placed in various locations to attract customers. The typical vending machine is a large cube-shaped container that usually includes a front opening door, where the opening door includes a clear display surface. The display surface allows the customer to view the items within the vending machine that are for sale. This clear panel needs to remain clean and clear in order to attract customers and further to allow for the customers to view the items within the vending machine. Currently there are not any particular solutions to address the cleaning process. Many times vending machine operators simply spray the display down with a hand spray and a paper towel. One drawback to this method is the vending operator must carry cleaning solution to clean the front display panel. It would therefore be advantageous to have a system installed that at least alleviates the necessity for the vending operator to transport cleaning solution along with other items while servicing a vending machine.

SUMMARY OF THE INVENTION

The present invention relates to a cleaning system for a vending machine comprising: a fluid container, where the fluid container is installed on an interior surface of a door of the vending machine; a tubing system extending from the fluid container along the sides of the door; and a pump switch configured in line with the tubing system, where the pump enables the flow of the fluid through the tubing system. The tubing system may include a container tubing extending from the fluid container to the pump switch. The tubing system may also include a side tubing extending from the pump switch and said side tubing connects to a top tubing, where the fluid dispenses from the top tubing.

BRIEF DESCRIPTION OF DRAWINGS

FIG. 1 depicts a vending machine with a vending cleaning system installed in accordance with the present invention.

DETAILED DESCRIPTION

The present invention relates to a vending cleaning system that may be installed within a conventional vending machine. The vending cleaning system enables the application and release of cleaning solution over a clear panel on the door of the vending machine. The vending cleaning system includes a cleaning fluid container that stores cleaning fluid. This cleaning fluid is dispensed through tubing system that runs along one side of the door panel. The tubing system extends to the topside of the display panel and allows for the dispensing of fluid over the panel surface.

With respect to FIG. 1, a vending machine 100 is depicted. In particular the vending machine 100 includes a body portion 50. The body portion 50 stores any items that are for sale through the vending machine 100. As with most vending machines, a door 25 is provided that is locked and opened to allow a vending operator to access the interior of the body portion 50. The door 25 includes a clear top surface that enables customers to view the items within the vending machine. On an inside lower panel 22 of the door 25, a fluid container 30 is installed. The fluid container 30 stores cleaning fluid that is dispensed through a tubing system that runs along the side of the door 25. A container tubing 32 extends out from the top of the container 30 and leads to a switch/pump 42. The switch/pump 42 pumps the fluid through the tubing 32 extending from the fluid container 30 and outward to a side tubing 34 and forward to a top tubing 36. Alternatively, the switch/pump 42 may also be installed on the key panel of the vending machine. The top tubing 36 has openings that allow for the dispensing of fluid onto the clear panel of the door 25. As this fluid is dispensed a user merely needs to wipe the cleaning solution and clean the clear surface of the vending door 25. The fluid may be dispensed onto either the outside or inside surface, or both, of the clear panel of the door 25.

The present vending cleaning system provides convenient means to clean and maintain a vending machine. Further the ability to store the fluid within the vending machine eliminates the necessity for a vending operator to transport cleaning solution while maintaining the vending machine. The instant invention has been shown and described in what it considers to be the most practical and preferred embodiments. It is recognized, however, that departures may be made there from within the scope of the invention and that obvious modifications will occur to a person skilled in the art.

What is claimed is:

1. A cleaning system for a vending machine comprising:

a. a fluid container, where the fluid container is installed on a lower panel of a door of the vending machine;

b. a tubing system extending from the fluid container along the sides of the door, wherein the tubing system is enabled to dispense fluid from the fluid container onto an upper clear surface of the door; and c. a pump switch configured in line with the tubing system, where the pump enables the flow of the fluid through the tubing system.

2. The cleaning system according to claim 1, where the tubing system includes a container tubing extending from the fluid container to the pump switch.

3. The cleaning system according to claim 2, where the tubing system includes a side tubing extending from the pump switch and said side tubing connects to a top tubing.

4. The cleaning system according to claim 3, where fluid dispenses from the top tubing.

* * * * *